US006070043A

United States Patent [19]

Fujita et al.

[11] Patent Number: 6,070,043

[45] Date of Patent: May 30, 2000

[54] DEVICE FOR CLEANING A TRANSFER BELT OF AN IMAGE-FORMING MACHINE

[75] Inventors: Shigeo Fujita; Ryuji Wataki; Yuzuru Nanjo, all of Osaka, Japan

[73] Assignee: Mita Industrial, Osaka, Japan

[21] Appl. No.: 09/006,659

[22] Filed: Jan. 13, 1998

[30] Foreign Application Priority Data

Jan. 17, 1997 [JP] Japan ..... 9-006126

[51] Int. Cl.[7] ..... G03G 15/16; G03G 21/00

[52] U.S. Cl. ..... 399/313; 399/312; 399/354

[58] Field of Search ..... 399/297, 310, 399/311, 312, 313, 314, 354, 353

[56] References Cited

U.S. PATENT DOCUMENTS

| | | | |
|---|---|---|---|
| 3,642,362 | 2/1972 | Mueller | 399/312 |
| 3,976,370 | 8/1976 | Goel et al. | 399/312 |
| 4,361,922 | 12/1982 | Karal | 399/353 X |
| 4,673,284 | 6/1987 | Matsumoto et al. | 399/353 X |
| 5,198,863 | 3/1993 | Goto et al. | 399/314 |
| 5,291,253 | 3/1994 | Kumasaka et al. | 399/312 X |
| 5,499,086 | 3/1996 | Matsuno et al. | 399/313 |
| 5,579,096 | 11/1996 | Saito et al. | 399/101 X |
| 5,631,725 | 5/1997 | Harasawa et al. | 399/66 |

*Primary Examiner*—Fred L. Braun
*Attorney, Agent, or Firm*—Antonelli, Terry, Stout & Kraus, LLP

[57] ABSTRACT

A device for cleaning a transfer belt of an image-forming machine in which the transfer belt is wound around a drive roller and a driven roller that are disposed at a predetermined distance, in parallel with each other and is positioned opposite a photosensitive material drum in a transfer zone. A fur brush which has an electrically conducting property is rotated in contact with the surface of the transfer belt. A bias voltage is applied to the fur brush, the bias voltage having a polarity the same as the polarity for electrically charging the toner of a toner image formed on the photosensitive material drum. An opposed electrode is disposed opposite the fur brush and in contact with the back surface of the transfer belt.

7 Claims, 3 Drawing Sheets

DEVICE FOR CLEANING A TRANSFER BELT OF AN IMAGE-FORMING MACHINE

FIELD OF THE INVENTION

The present invention relates to a device for cleaning a transfer belt that is mounted on an image-forming machine, such as an electrostatic copier, a laser printer, a facsimile machine or the like. More specifically, the invention relates to a device for cleaning a transfer belt, equipped with a fur brush for removing toner adhered onto the transfer belt.

DESCRIPTION OF THE PRIOR ART

In image-forming machines such as electrostatic copiers, laser printers, facsimile machines, etc., a transfer device having a transfer belt has been widely put into use for transferring toner image formed on the peripheral surface of a photosensitive material drum onto a transfer paper. In the transfer device using a transfer belt, if jamming of papers or the like occurs in the transfer paper conveying passage, the toner on the peripheral surface of the photosensitive material drum often adheres onto the surface of the transfer belt. When the transfer operation is conducted in a state where toner is adhered onto the surface of the transfer belt, the toner on the transfer belt adheres to the back surface of the transfer paper that is fed in the next time, causing the back surface of the transfer paper to be fouled.

In order to eliminate such an inconvenience, the transfer device using a transfer belt has been equipped with a cleaning device for removing toner adhered on the surface of the transfer belt. As one cleaning device of this type, there has been put into practical use a device according to which a fur brush, while being brought into contact with the transfer belt, is rotated in order to remove the toner adhered onto the surface of the transfer belt.

There will be no problem if the toner adhered onto the transfer belt is all removed by the fur brush as the surface of the transfer belt passes over the fur brush. It is, however, difficult to reliably remove all of the toner adhered onto the transfer belt. When the toner adhered onto the transfer belt is not all removed, but some remains, the residual toner adheres onto the back surface of the transfer paper at the time of the next transfer operation, causing the back surface of the transfer paper to be fouled.

SUMMARY OF THE INVENTION

A principal object of the present invention is to provide a device for cleaning a transfer belt which is capable of preventing residual toner from adhering onto the back surface of the transfer paper at the time of the next transfer operation even when the toner is not all removed by the fur brush but, some toner remains when the surface of the transfer belt onto which the toner is adhered has passed over the fur brush.

Another object of the present invention is to provide a device for cleaning a transfer belt, which is capable of preventing the fur brush from being loaded with the removed toner, without impairing the cleaning function of the fur brush.

In order to accomplish the above-mentioned principal object according to the present invention, there is provided a device for cleaning a transfer belt which is wound around a drive roller and a driven roller that are, at a predetermined distance, disposed in parallel with each other, and which is positioned to be opposed to a photosensitive material drum in a transfer zone, comprising:

a fur brush that has electrically conducting property and is rotated while coming in contact with the surface of said transfer belt;

a bias voltage application means for applying a bias voltage to said fur brush, said bias voltage having the same polarity as that for electrically charging the toner of the toner image formed on said photosensitive material drum; and an opposed electrode disposed opposite said fur brush and in contact with the back surface of said transfer belt.

The bias voltage application means is set to a voltage at which the toner can be electrically charged to a saturated state.

In order to accomplish the above-mentioned other object according to the present invention, furthermore, there is provided a device for cleaning a transfer belt, wherein a contact region between said fur brush and said transfer belt includes a strong electric field region opposite where said opposed electrode is positioned and a weak electric field region opposite where said opposed electrode is not positioned.

The strong electric field region and the weak electric field region are formed neighboring to each other in a direction in which the transfer belt moves. It is preferred that the strong electric field region be formed on the downstream side of the weak electric field region in the direction in which the transfer belt moves.

Moreover, the fur brush can be constituted such that it is disposed opposite the drive roller and the drive roller works as the opposed electrode. Furthermore, it is also possible to constitute the fur brush to be disposed opposite the driven roller and the driven roller works as the opposed electrode.

Other objects and features of the present invention will become obvious from the following description.

DETAILED DESCRIPTION OF THE PREFERRED EMBODIMENTS

Preferred embodiments of a device for cleaning the transfer belt of an image-forming machine constituted according to the present invention will now be described in detail with reference to the accompanying drawings.

Figure 1:
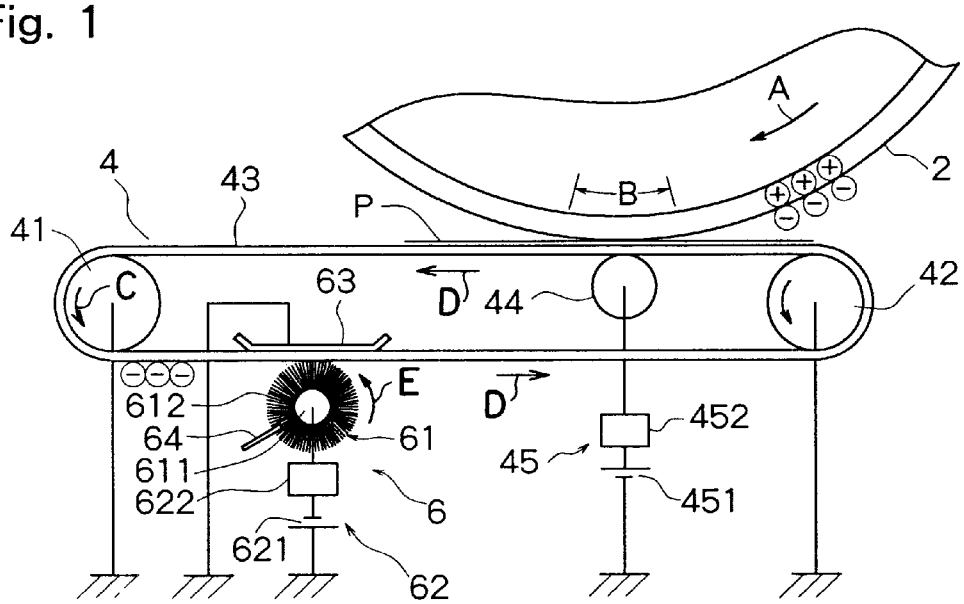
FIG. 1 is a view schematically illustrating a transfer belt mechanism having a cleaning device constituted according to a first embodiment of the present invention.

FIG. 1 illustrates a device for cleaning the transfer belt mechanism of an image-forming machine constituted according to a first embodiment of the present invention.

In FIG. 1, a photosensitive material drum designated at 2, which is an image carrier, is rotatably disposed in a machine housing of an image-forming machine and is rotated in the direction indicated by an arrow A by a drive mechanism that is not shown. The peripheral surface of the photosensitive material drum 2 is electrically and evenly charged (e.g., +800 V) in a predetermined polarity in a charging zone by a charger. An electrostatic latent image of image data is formed on the peripheral surface of the thus electrically charged photosensitive material drum 2 in an electrostatic latent image-forming zone by an exposure means, such as a laser unit or the like. The electrostatic latent image thus formed on the peripheral surface of the photosensitive material drum 2 is developed into a toner image in a developing zone by a developer. The toner image formed on the peripheral surface of the photosensitive material drum 2 is transferred onto a transfer paper while it passes through a transfer zone B as will be described in more detail later.

A transfer belt mechanism 4, which is a transfer device, is disposed on the lower side of the photosensitive material drum 2. The transfer belt mechanism 4 includes a drive roller 41 and a driven roller 42 disposed in parallel with each other at a predetermined distance, a transfer belt 43 which is wound around the drive roller 41 and the driven roller 42 and comes into contact with the peripheral surface of the photosensitive material drum 2 in the transfer zone B, a transfer roller 44 which is, in the transfer zone B, opposed to the photosensitive material drum 2, with the transfer belt 43 being sandwiched therebetween, and comes into contact with the back surface of the transfer belt 43, and a bias voltage application means 45 for applying a predetermined transfer bias voltage to the transfer roller 44.

The drive roller 41 and the driven roller 42 have a size in the axial direction which is nearly the same as the length in the axial direction of the photosensitive material drum 2, and rollers 41 and 42 are constituted of an aluminum alloy in the illustrated embodiment. As the drive roller 41 is rotated by a drive means that is not shown in a direction indicated by arrow C, the transfer belt 43 wound around the drive roller 41 and the driven roller 42 is moved in a direction indicated by arrows D.

The transfer belt 43 has a size in the direction of width thereof, which is nearly the same as the length of the drive roller 41 and the driven roller 42 in the axial direction thereof, and, in the illustrated embodiment, is made up of an endless belt having a thickness of about 0.6 mm, obtained by coating an urethane rubber with a fluorine tetrachloride resin (Teflon, trade name). The transfer belt 43 has a volume electric resistivity of from about $10^6$ to about $10^{12}$ Ωcm.

The transfer roller 44 has a length in the axial direction thereof, which is nearly the same as the size in the width direction of the transfer belt 43 and is constituted of a foamed urethane rubber in the illustrated embodiment. The transfer roller 44 has a volume electric resistivity of from about $10^3$ to about $10^4$ Ωcm.

The bias voltage application means 45 comprises a power source 451 for applying a predetermined bias voltage to the transfer roller 44 and a constant-current controller 452 disposed between the power source 451 and the transfer roller 44, and applies a predetermined constant current (e.g., +40 to +100 μA) to the transfer roller 44, the predetermined constant current having a polarity opposite to the polarity (negative polarity in the illustrated embodiment) for charging the toner adhered to the peripheral surface of the photosensitive material drum 2. The voltage in this case is +3 to +4 KV in the illustrated embodiment. In the illustrated embodiment, the drive roller 41 and the driven roller 42 are grounded, and the electric charge accumulated on the transfer belt 43 is removed through the drive roller 41 and the driven roller 42.

The illustrated transfer belt mechanism 4 is equipped with a cleaning device 6 for removing the toner adhered onto the surface of the transfer belt 43. The cleaning device 6 includes a fur brush 61 that is disposed on the lower side of the transfer belt 43 of the transfer belt mechanism 4 and rotates in contact with the surface of the transfer belt 43, a bias voltage application means 62 for applying a predetermined bias voltage to the fur brush 61, an opposed electrode 63 opposed to the fur brush 61 with the transfer belt 43 being sandwiched therebetween, and a toner scraping member 64 for scraping from the fur brush 61 the toner that has been removed from the surface of the transfer belt 43 by the fur brush 61.

The fur brush 61 comprises a metallic rotary shaft 611 and an electrically conducting brush portion 612 mounted on the rotary shaft 611 and has nearly the same length in the axial direction thereof as the size in the width direction of the transfer belt 43. The brush portion 612 is constituted by implanting an electrically conducting polyester fiber on an electrically conducting fabric and is adhered to the peripheral surface of the rotary shaft 611 by using an electrically conducting double-sided adhesive tape. In the illustrated embodiment, the polyester fiber constituting the brush portion 612 has an electric resistance of $10^3$ to $10^4$ Ω. The thus constituted fur brush 61 is rotated by a drive means, that is not shown, in a direction indicated by arrow E, i.e., in a direction opposite to the direction in which the transfer belt 43 moves at the portion thereof that is brought into contact with the transfer belt 43.

The bias voltage application means 62 comprises a power source 621 for applying a predetermined bias voltage to the fur brush 61 and a constant-current controller 622, disposed between the power source 621 and the fur brush 61, and applies a predetermined constant current (e.g., −5 to −40 μA) to the fur brush 61, the predetermined constant current having the same polarity (negative polarity in the illustrated embodiment) as the polarity for charging the toner. The voltage in this case is from about −1.0 to −1.5 KV at which the toner can be electrically charged to its saturated state in the illustrated embodiment.

The opposed electrode 63 is disposed in contact with the back surface of the transfer belt 43 and is grounded.

The toner scraping member 64 has nearly the same size in the width direction thereof as the length of the fur brush 61 in the axial direction thereof and has its one end inserted in the brush portion 612 of the fur brush 61.

The transfer belt mechanism equipped with the device for cleaning the transfer belt according to the embodiment of FIG. 1 is constituted as described above. Described below are its action and effect.

A transfer paper P, fed by a transfer paper feeding means that is not shown, is conveyed from the right side toward the transfer zone B in the drawing. While the transfer paper P passes between the photosensitive material drum 2 and the transfer belt 43 in the transfer zone B, a predetermined bias voltage, of a polarity opposite to the polarity for charging the toner adhered onto the peripheral surface of the photosensitive material drum 2, is applied to the transfer belt 43 by the bias voltage application means 45 through the transfer roller 44, so that the toner image adhered to the peripheral surface of the photosensitive material drum 2 is transferred onto the transfer paper P. The transfer paper P, onto which the toner image is thus transferred, is then conveyed by the transfer belt 43 toward the left in the drawing and the toner image is heated and fixed by a fixing means (not shown) disposed on the left side of the transfer belt mechanism 4 in the drawing.

When the transfer paper P is not conveyed to the transfer zone B due to jamming or the like at the time of forming the image, the toner on the peripheral surface of the photosensitive material drum 2 adheres onto the transfer belt 43. The transfer belt 43, to which the toner is adhered, moves in the direction indicated by the arrows D, and the toner adhered onto the transfer belt 43 is removed by the fur brush 61 of the cleaning device 6. The toner removed from the surface of the transfer belt 43 is caused to fall down from the fur brush 61 by the toner scraping member 64 and is contained in a toner receiver that is not shown.

There will be no problem if the toner adhered onto the transfer belt 43 can be all removed by the fur brush 61. When toner remains on the transfer belt 43 without being removed, however, the residual toner adheres onto the back surface of the transfer paper P at the time of the next transfer operation and causes the back surface of the transfer paper to be fouled. According to the illustrated embodiment, however, a bias voltage of a polarity the same as the polarity for charging the toner is applied to the fur brush 61 by the bias voltage application means 62, as described above, and hence the residual toner is further electrically charged through the fur brush 61. It is desired that the amount of electric charge with which the residual toner is charged be a saturation charge (e.g., $-30\ \mu c/g$) for the toner, as described above. Accordingly, it is desired that the voltage and current of the bias voltage application means 62 be so set that the residual toner can be electrically charged to its saturated state. As the amount of the electric charge for the residual toner increases as described above, the electric adsorptive force of the transfer belt 43 increases, and a bias voltage of a polarity opposite to the polarity for charging the toner is applied to the transfer belt 43 from the bias voltage application means 45 through the transfer roller 44 in the transfer zone B. Therefore, the residual toner does not adhere onto the back surface of the transfer paper P at the time of the next transfer operation.

Figure 2:
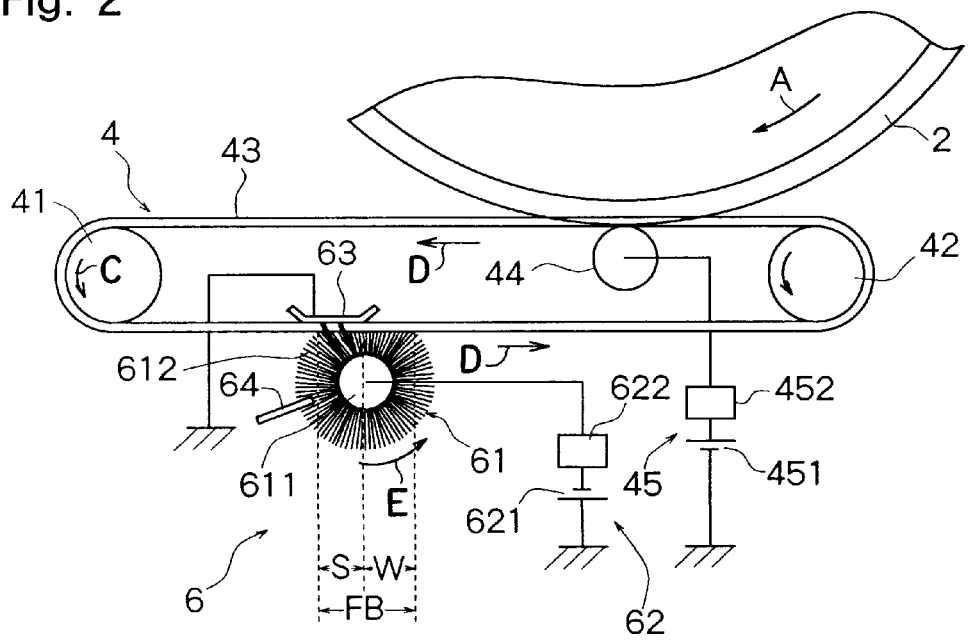
FIG. 2 is a view schematically illustrating a transfer belt mechanism having a cleaning device constituted according to a second embodiment of the present invention.

Next, described below with reference to FIG. 2 is a device for cleaning the transfer belt constituted according to a second embodiment of the present invention. In FIG. 2, the same members as those of the embodiment of FIG. 1 are denoted by the same reference numerals, and so their description is not repeated.

The embodiment shown in FIG. 2 is different from the embodiment shown in FIG. 1 in regard to a positional relationship between the opposed electrode 63 and the fur brush 61 that constitute the cleaning device 6. With reference to the direction in which the transfer belt 43 moves, shown by arrows D, the opposed electrode 63 in the embodiment shown in FIG. 2 is disposed on the upstream side of the center of a region (FB) where the fur brush 61 comes in contact with the transfer belt 43. Therefore, in the contact region (FB) there is formed a strong electric field region (S) opposite the area where the electrode 63 is positioned and a weak electric field region (W) opposite the area where the opposed electrode 63 is not positioned.

In the thus constituted cleaning device 6, the toner adhered onto the surface of the transfer belt 43 is removed chiefly in the weak electric field region (W). That is, since the electric field is weak in the weak electric field region (W), there is almost no electric repulsion between the fur brush 61 and the toner, and the fur brush exhibits its own cleaning function. In the strong electric field region (S), on the other hand, an electric field is established between the fur brush 61 and the opposed electrode 63, and a strong electric repulsion is produced between the fur brush 61 and the toner. Therefore, the fur brush 61 is not loaded with the toner removed from the transfer belt 43 by the fur brush 61, and the toner is caused to fall down by the toner scraping member 64 with the rotation of the fur brush 61. When, for example, the opposed electrode 63 is disposed over the whole contact region (FB) as in the embodiment shown in FIG. 1, an effect of preventing the fur brush from being loaded with the toner is exhibited to a sufficient degree, but the cleaning function of the fur brush is impaired This is because the electric repulsion is so strong between the fur brush and the toner that is to be scraped off by the fur brush from the surface of the transfer belt, with the consequence that the toner to be scraped off is not sufficiently scraped off, or the toner once scraped off flies and adheres onto the transfer belt again due to the electric repulsion between it and the fur brush. In the embodiment shown in FIG. 2, however, a strong electric field region (S) and a weak electric field region (W) are formed in the region (FB) where the fur brush 61 and the transfer belt 43 come in contact with each other. Accordingly, the cleaning function of removing the toner is chiefly exhibited in the weak electric field region (W), and the function of preventing the loading is exhibited in the strong electric field region (S). It is thus made possible to obtain a device for cleaning the transfer belt capable of preventing the fur brush from being loaded with the removed toner without impairing the cleaning function.

In the illustrated cleaning device 6 of FIG. 2, the ratio between the cleaning function and the function of preventing the loading can be adjusted by changing the ratio between the weak electric field region (W) and the strong electric field region (S). When a plate-like electrode plate is used as the opposed electrode 63 as in the embodiment shown in FIG. 2, in particular, there is provided a great freedom of adjustment.

When the toner adhered onto the surface of the transfer belt 43 is not removed by the fur brush 61 despite the fact that the portion of the transfer belt 43 that has the toner on it has passed through the contact region (FB), the residual toner is electrically charged through the fur brush 61 up to its saturated state in a polarity the same as that portion of the transfer belt 43 polarity for charging the toner, as it passes through the strong electric field region (S). In consequence, the transfer belt 43, to which is applied a bias voltage of a polarity opposite to the polarity for charging the toner from the bias voltage application means 45 through the transfer roller 44 in the transfer zone B, has increased electric adsorptive force, and hence the residual toner does not adhere onto the back surface of the transfer paper P at the time of the next transfer operation.

Figure 3:
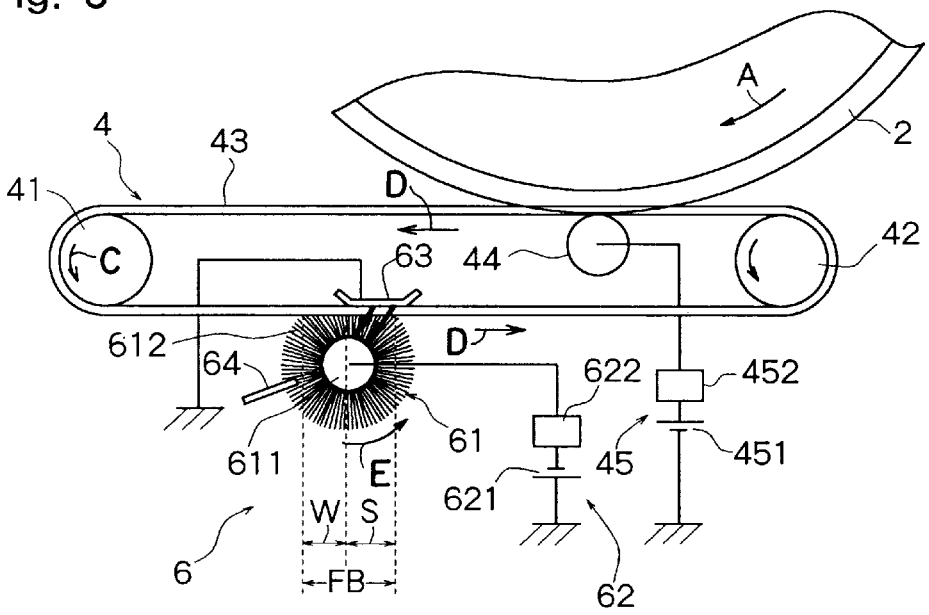
FIG. 3 is a view schematically illustrating a transfer belt mechanism having a cleaning device constituted according to a third embodiment of the present invention.

Next, a third embodiment of a cleaning device constituted according to the present invention will be described with reference to FIG. 3. In FIG. 3, the same members as those shown in FIGS. 1 and 2 are denoted by the same reference numerals, and so their description is not repeated.

The embodiment shown in FIG. 3 is different from the embodiment shown in FIG. 2 in regard to the positional relationship between the opposed electrode 63 and the fur brush 61 that constitute the cleaning device 6. With reference to the direction in which the transfer belt 43 moves, shown by arrows D, the opposed electrode 63 in the embodiment shown in FIG. 3 is disposed on the downstream side of the center of the region (FB) where the fur brush 61 comes in contact with the transfer belt 43. In the contact region (FB) of FIG. 3, therefore, a strong electric field region (S) is formed opposite where the opposed electrode 63 is positioned on the downstream side of a weak electric field region (W) that is formed opposite where the opposed electrode 63 is not positioned. Therefore, the toner adhered onto the surface of the transfer belt 43 is, first, removed by the fur brush 61 in the weak electric field region (W) on the upstream side with reference to the direction in which the transfer belt 43 moves. The residual toner that is not removed is, then, electrically charged through the fur brush 61 with a polarity the same as the polarity for charging the toner as it passes through the strong electric field region (S). Therefore, the residual toner of a small amount is reliably charged, through the fur brush 61, up to its saturated state as it passes through the strong electric field region (S). Accordingly, the transfer belt 43 exhibits an increased electric adsorptive force and more reliably prevents the toner from adhering onto the back surface of the transfer paper at the time of the next transfer operation.

Figure 4:
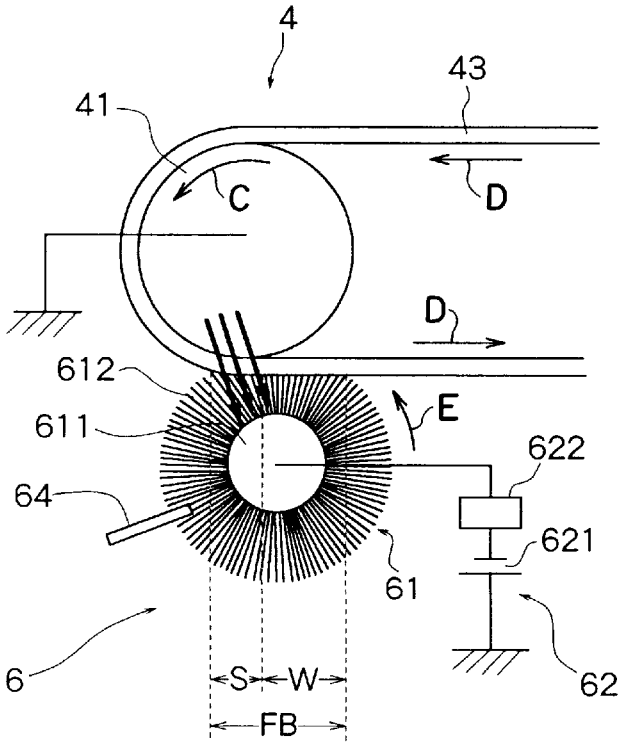
FIG. 4 is a view schematically illustrating the constitution of major portions of a transfer belt mechanism having a cleaning device constituted according to a fourth embodiment of the present invention.

Next, a fourth embodiment of the cleaning device constituted according to the present invention will be described with reference to FIG. 4. In FIG. 4, the same members as those shown in FIGS. 1 to 3 are denoted by the same reference numerals, and so their description is not repeated.

In the embodiment shown in FIG. 4, the fur brush 61 constituting the cleaning device 6 is disposed at a position where it is opposite the drive roller 41 of the transfer belt mechanism 4, and the drive roller 41 is utilized as an opposed electrode. In this embodiment, too, there are formed a strong electric field region (S), opposite the drive roller 41 which is the opposed electrode, and a weak electric field region (W), not opposite the drive roller 41. The strong and weak electric field regions (S) and (W) are in the region (FB) where the fur brush 61 and the transfer belt 43 come in contact with each other and exhibit the same action and effect as those of the embodiment shown in FIG. 2. In the embodiment shown in FIG. 4, furthermore, the drive roller 41 in the transfer belt mechanism 4 works as the opposed electrode, making it possible to decrease the number of parts and to decrease the cost for producing the transfer belt cleaning device.

Figure 5:
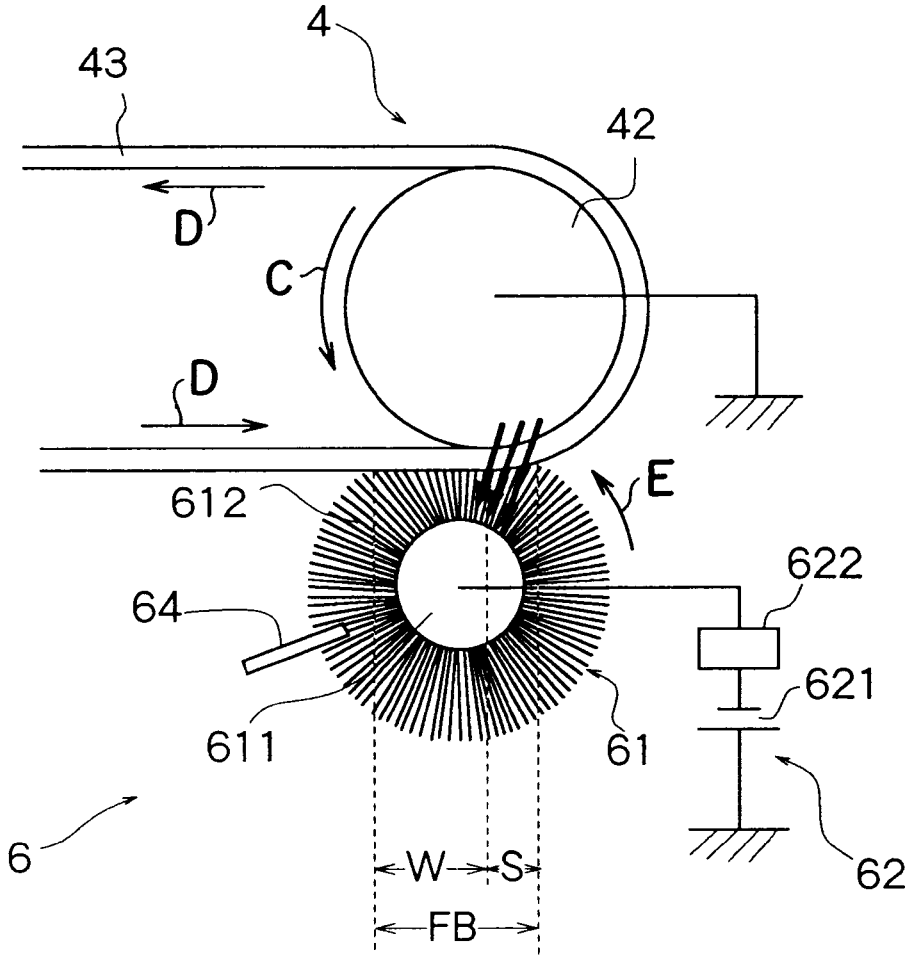
FIG. 5 is a view schematically illustrating the constitution of major portions of a transfer belt mechanism having a cleaning device constituted according to a fifth embodiment of the present invention.

Next, a fifth embodiment of a cleaning device constituted according to the present invention will be described with reference to FIG. 5. In FIG. 5, the same members as those shown in FIGS. 1 to 3 are denoted by the same reference numerals, and so their description is not repeated.

In the embodiment shown in FIG. 5, the fur brush 61 constituting the cleaning device 6 is disposed at a position where it is opposite the driven roller 42 of the transfer belt mechanism 4, and the driven roller 42 is utilized as an opposed electrode. In this embodiment, there are formed a strong electric field region (S), opposite the driven roller 42 which is the opposed electrode and a weak electric field region (W), not opposite the driven roller 42. The strong and weak electric field regions (S) and (W) are in the region (FB) where the fur brush 61 and the transfer belt 43 come in contact with each other and exhibit the same action and effect as those of the embodiment shown in FIG. 3. In the embodiment shown in FIG. 5, the strong electric field region (S) is formed on the downstream side of the weak electric field region (W) with reference to the direction in which the transfer belt 43 moves. Like in the embodiment shown in FIG. 3, therefore, the toner adhered onto the surface of the transfer belt 43 is, first, removed by the fur brush 61 in the weak electric field region (W) on the upstream side with reference to the direction in which the transfer belt 43 moves, and the residual toner that is not there removed is electrically charged to a polarity the same as the polarity for charging the toner through the fur brush 61 as that residual toner passes through the strong electric field region (S). Therefore, the residual toner is reliably charged, through the fur brush 61, up to its saturated state as it passes through the strong electric field region (S). Accordingly, the transfer belt 43 exhibits an increased electric adsorptive force and more reliably prevents the toner from adhering onto the back surface of the transfer paper at the time of the next transfer operation.

What we claim is:

1. A device for cleaning a transfer belt which is wound around a drive roller and a driven roller that are disposed, at a predetermined distance in parallel with each other in an image-forming machine, and which is positioned to be opposite a photosensitive material drum in a transfer zone of the image-forming machine, said device comprising:

an electrically conductive fur brush;

means for mounting said fur brush for rotation in contact with the surface of said transfer belt;

a bias voltage source for applying to said fur brush a bias voltage having the same polarity as that for electrically charging toner of a toner image formed on said photosensitive material drum; and an opposed electrode disposed opposite said fur brush and in contact with the back surface of said transfer belt.

2. A device for cleaning a transfer belt according to claim 1, wherein said bias voltage source applies the bias voltage at a voltage level which electrically charges the toner to a saturated state.

3. A device for cleaning a transfer belt according to claim 1, wherein said opposed electrode is positioned to define a contact region between said fur brush and said transfer belt with the contact region including a strong electric field region opposite where said opposed electrode is positioned and a weak electric field region opposite where said opposed electrode is not positioned.

4. A device for cleaning a transfer belt according to claim 3, wherein said strong electric field region and said weak electric field region are formed neighboring to each other in a direction in which said transfer belt moves.

5. A device for cleaning a transfer belt according to claim 4, wherein said strong electric field region is formed on the downstream side of said weak electric field region with reference to the direction in which said transfer belt moves.

6. A device for cleaning a transfer belt according to claim 1, wherein said drive roller forms said opposed electrode.

7. A device for cleaning a transfer belt according to claim 1, wherein said driven roller forms said opposed electrode.

* * * * *